United States Patent [19]

Blotenberg

[11] Patent Number: 4,810,163

[45] **Date of Patent: * Mar. 7, 1989**

[54] METHOD OF CONTROLLING A TURBOCOMPRESSOR

[75] Inventor: Wilfried Blotenberg, Dinslaken, Fed. Rep. of Germany

[73] Assignee: MAN Gutehoffnungshutte GmbH, Fed. Rep. of Germany

[ * ] Notice: The portion of the term of this patent subsequent to Dec. 6, 2005 has been disclaimed.

[21] Appl. No.: 924,858

[22] Filed: Oct. 29, 1986

[30] Foreign Application Priority Data

Nov. 12, 1985 [DE] Fed. Rep. of Germany ..... 3540087

[51] Int. Cl.[4] ..... F04D 27/02

[52] U.S. Cl. ..... 415/27; 415/17

[58] Field of Search ..... 415/1, 17, 27, 28

[56] References Cited

U.S. PATENT DOCUMENTS

| | | | |
|---|---|---|---|
| 4,139,328 | 2/1979 | Kuper et al. | 415/27 |
| 4,274,260 | 6/1981 | Bukajlo | 415/17 |
| 4,560,319 | 12/1985 | Blotenberg | 415/27 |
| 4,562,531 | 12/1985 | Enterline et al. | 415/27 |
| 4,586,870 | 5/1986 | Hohlweg et al. | 415/27 |
| 4,627,788 | 12/1986 | Keyes, IV et al. | 415/27 |
| 4,640,665 | 2/1987 | Staroselsky et al. | 415/27 |
| 4,656,589 | 4/1987 | Albers et al. | 415/17 |

FOREIGN PATENT DOCUMENTS

| | | | |
|---|---|---|---|
| 157307 | 12/1979 | Japan | 415/27 |
| 2036177 | 6/1980 | United Kingdom | 415/27 |

*Primary Examiner*—Robert E. Garrett
*Assistant Examiner*—John T. Kwon
*Attorney, Agent, or Firm*—McGlew and Tuttle

[57] ABSTRACT

To prevent a compressor from pumping, a blow-off or reorientation valve branched off its outlet is controlled by a controller as a function of the working point location of the compressor relative to a blow-off line defined in the characteristic field. According to the invention, the differential component of the controller behavior, in particular, the time constant governing the differentiation, is so controlled as a function of the working point location that the differentiating effect is great near the blow-off line and sight at a greater distance from the blow-off line.

8 Claims, 1 Drawing Sheet

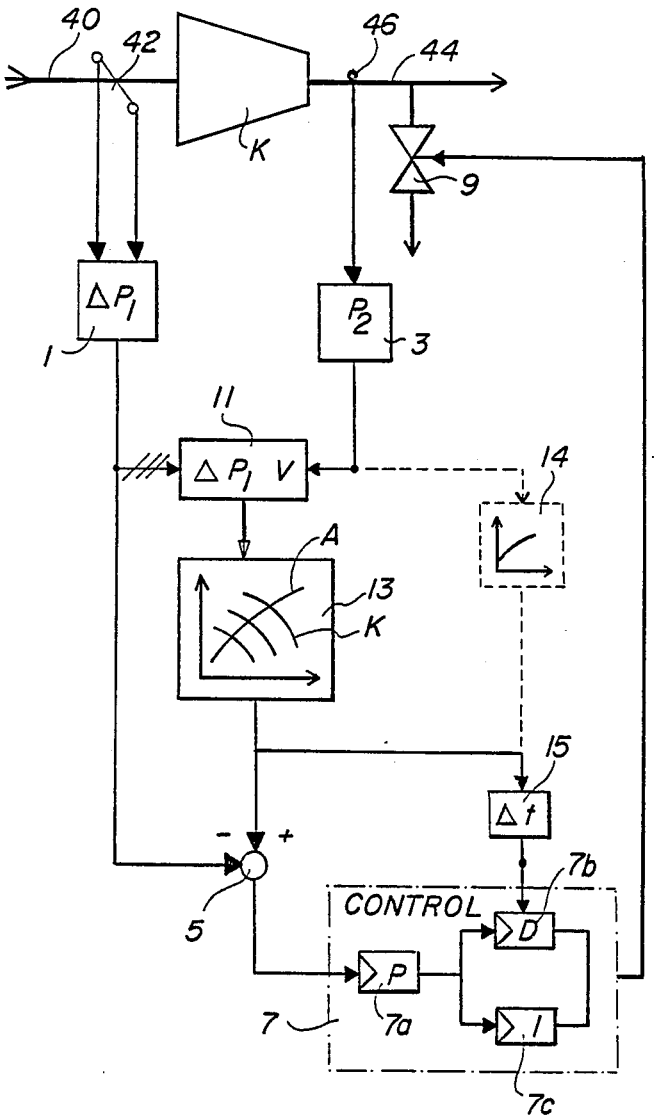
40
42
46
44
K
9
ΔP1
1
P2
3
11
ΔP1 V
14
A
13
K
15
Δt
7b
CONTROL
D
P
I
7
7a
7c
5
-
+

METHOD OF CONTROLLING A TURBOCOMPRESSOR

FIELD AND BACKGROUND OF THE INVENTION

This invention relates in general to compressors and in particular to a new and useful turbocompressor having an improved control for preventing pumping.

The invention relates to a method of controlling turbocompressors which is particularly well suited for the so-called pumping limit control to prevent the pumping of a compressor. But it can also be applied to other controls such as an antichoke control, turbine speed control, etc.

A method for the pumping limit control is known from the article "Turbolog—The Electronic Control System for GHH Turbomachiens" in Nachrichten fur den Maschinenbau (News for Machine Builders) No. 3, May 1982 and also from the U.S. Pat. No. 4,142,838. A method of the kind mentioned, in which the differentiation is realized by subtracting the delayed from the undelayed signal is also known from German Pat. No. 28 28 124. Pumping is understood to be an instable turbocompressor behavior in which the feed medium flows in surges or periodically from the compression or discharge side back to the suction side. This behavior sets in when the throughput is too low or the compression ratio between compressor inlet and outlet is too high. The so-called pumping limit line in the compressor's operating characteristic field separates the stable from the instable range. The pumping limit control insures that when the momentary working point approaches the pumping limit line or a blow-off line running parallel to the pumping limit line at a safety distance, a blow-off or recycle valve at the compressor outlet is opened. It is also known in this method to vary the control behavior of the controller generating the positioning signal for the blow-off valve as a function of the working point location by increasing non-linearly the control amplification when the blow-off line is crossed.

In such controls, the use of controllers with a control component differentiating the input signal encounters a number of difficulties. One of these difficulties is the fact that an actual signal derived from the throughput has a very high superposed noise level, thereby rendering a differentiation very difficult. This difficulty is less pronounced when the actual value signal is derived from the end pressure.

Another disadvantage of using a controller with a differential component is the fact that the characteristic constant speed lines and/or the characteristic field is formed by compression ratio and throughput. In the proximity of the pumping limit these compressor characteristic lines are very flat while they are steep far in the characteristic field. The consequence thereof is that the modification of the compressor end pressure near the pumping limit is only vert slight. Accordingly, the diffential component of the controller also has the least effect near the pumping limit. But this is precisely the characteristic field area in which a differential component of the controller would be needed the most to achieve a quick response, because the compressor is most endangered in this area.

SUMMARY OF THE INVENTION

The invention further develops a method of controlling a compressor so that it offers the possibility of an effective control with differential behavior also and especially in the proximity of operation at the pumping limit line.

Accordingly it is an object of the invention to provide a method of controlling a compressor so as to prevent it from pumping by controlling the operation of a blow-off valve and also by measuring the operating condition of the compressor during the control and varying the blow-off valve control accordingly.

A further object of the invention is to provide an apparatus for controlling an operation of a compressor which includes a blow-off valve and means for measuring conditions at the inlet and outlet of the compressor such as pressure temperature and throughput through the compressor and for using a computer to control the operation of a compressor in accordance with preset values which indicate the end conditions for operation of the compressor which will not cause pumping and which further includes means for further measuring the operating conditions of the compressor at any particular operating moment and providing a further superimposed control on the compressor in accordance therewith.

A further object of the invention is to provide an apparatus for controlling a compressor which is simple in design, rugged in contruction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

The only FIGURE of the drawing is a schematic representation of a compressor and a control system therefor for preventing pumping constructed in accordance with the invention.

DESCRIPTION OF THE PREFERRED EMBODIMENT

Referring to the drawing in particular the invention embodied therein comprises a turbo compressor K having an inlet 40 with a sensor 42 and a discharge 44 with a sensor connection 46 provided for obtaining operating conditions of the compressor such as a pressure or other information for determining the throughput through the compressor for the purpose of operating a controller generally designated 7 for varying the opening and closing of a blow-off valve 9 connected to the discharge 44.

A first actual value sensor 1 on the suction side or suction line 40 of a compressor K acquires the pressure difference ahead of and behind of a throttling aperture located at 42 and thus also a measure of the volumetric flow aspired or the compressor throughput and produces a sensor signal. A second actual value sensor 3 acquires the end pressure $P_2$ at the compressor line 44 and produces a sensor signal. From these actual values, a computer 11 with associated memory 13 forms the coordinates of the operating point or working point or value of sensor signal in the characteristic field defined by the throughput and the ratio of end pressure to suction pressure and compares them with a blow-off line or curve A preset in the characteristic field and stored. As a function of the end pressure, a set-point signal for the throughput is generated which is compared with the actual value in a subtractor 5, and an input signal for a controller 7 is formed therefrom. The controller 7 has a proportional section *7a*, a differential section *7b* and an integral section *7c*. The controller output signal serves as positioning signal for a blow-off valve 9 at the compressor outlet. When the working point of the compressor approaches the blow-off line A, the throughput is increased or the end pressure decreased by opening the blow-off valve 9 appropriately.

Also stored in the memory 13 for each working point is the gradient of the constant speed and/or constant blade position or also constant inlet butterfly valve position a characteristic line of the compressor K going through the particular working point. From the actual value of the compressor characteristic line gradient belonging to the mementary working point a control element 15 generates a control signal, by means of which the time constant Δt effective for the differentiation in the differential section *7b* is varied so that the differentiating effect of the time constant is proportional or to the gradient of the compressor characteristic line. What this achieves is that the differential component of the controller 7 has approximately the same effectiveness in the entire characteristic field.

Instead of being varied as a function of the compressor characteristic line gradient, the differentiation time constant Δt may also be varied as a function of the distance of the momentary working point from the blow-off line again in such a manner that the diffentiating effect is increased with decreasing distance between blow-off line and working point, and vice versa.

In further development of the invention, the magnitude of the diffentiating effect, i.e. the share of the differential section *7b* relative to the proportional section *7a* and integral section *7c* may be varied. In particular, the magnitude of the differentiating effect may be matched as a function of the blow-off line gradient or of the end pressure valve.

It is further possible to lock on or cut off the differential component *7b* as a function of a limital value in the controller output. For example, the differential component *7b* can be cut off when the controller output signal reaches 100% of the input signal or of another preset value corresponding to a certain distance from the blow-off line.

The differential component *7b* of the controller may also be such as to be effective in one direction, e.g. when the input signal is increasing so that it can emit only a positive, but no negative output signal.

The control of the differentiation time constant need not be strictly in accordance with the actual characteristic line gradient. Rather, simplifications are possible.

One simplification comes about when the gradient of the characteristic lines of one of the characteristic field coordinates is a function of the pressure or of the throughputs or pressures. This is the case when the characteristic lines A in the range of slower speeds or vane positions end relatively steeply in the pumping limit while being flatter in the upper range. Also, if the characteristic lines are not quite congruent, an approximation by parallel shifting a characteristic line is permissible in many cases.

In this case, the magnitude of the characteristic line gradient and, hence, the magnitude of the differentiation time constant Δt depends solely upon the pressure P or the throughput V. The shape of the characteristic line can either be stored in a digital memory, or else it can be analogously preset in a function generator 14 which is indicated in dashed lines in the drawing. The input of the function generator is the pressure, the output directly the variable Δt. The same applies if Δt depends on throughput V. In this case, ΔP - signal from transducer 1 is fed to function generator 14 instead of the end pressure.

Other simplifications are possible in that the function is not simulated ideally in the function generator, but in approximation through straight sections. The simplest case is a straight line of two sections. It can be realized very simply by switching the Δt value to another value, starting at a preset pressure or throughput.

It is imaginable as another embodiment to switch between different gradients as a function of the throughput. This can be done either by switching to another function generator with a different function or by only varying individual parameters, such as the amplification in the entire range or the salient point.

There are other compressor characteristic fields in which the characteristic line gradient near the pumping limit is always the same or at least similar. In that case it is possible to vary the differentiation time constant $T_D$ as a function of the distance between working point and pumping limit or blow-off line. The distance between blow-off line and working point is present, e.g. as a control difference (input signal to the controller 7).

In this case, the function generator 14 furnishing Δt can be adjusted as a function of the control difference at the difference element 5. Of course, simplifications are possible also for this function generator, starting with simply switching Δt between two values over several straight sections right up to a polygonal progression.

Instead of differentiating in the controller itself, differentiation can also take place outside of the controller. It is known from German Pat. No. 28 28 142, in order to acquire the change rate of an actual value, to feed this actual value or its difference from the set-point value to a subtractor once delayed and once undelayed actual value as a "quasi differentiated" signal. Such a method is applicable also within the scope of the invention, the "quasi-differentiated" signal being fed to a controller having only proportional and integral behavior, and the time delay used to obtain the "quasi-differentiated" signal being varied as a function of the working point location.

While a specific embodiment of the invention has been shown and described in detail to illustrate the application of the principles of the invention, it will be understood that the invention may be embodied otherwise without departing from such principles.

What is claimed is:

1. A method of controlling a turbocompressor having an inlet line and a discharge line with a blow-off regulating valve, a turbocompressor having a predetermined characteristic field based on a relationship between one or more operating variables of the turbocompressor, the turbocompressor operating at an operating point in the characteristic field, a characteristic curve lying in the characteristic field representing a predetermined preferred relationship between one or more of the the operating variables, comprising the steps of: generating an input signal from a continuously acquired actual value of at least one operating variable of the turbocompressor providing an indication of at least of the volumetric flow, inlet pressure, discharge pressure and compression ratio; receiving said input signal at a controller input of a controller; processing said input signal in the controller to generate an output control signal to control the blow-off valve said output contorl signal having a differential component, said step of processing the input signal including forming the derivative of the input signal, as a control signal differential component, in a differential controller for the acquisition of the rate of change of the input signal, continuously establishing a momentary operating point of the turbocompressor based on the input signal with respect to the turbocompressor predetermined characteristic field of one or more operating variables, varying the control output signal in accordance with the relationship of the operating point with respect to the characteristic field varying the magnitude of the differential component of said control output signal in dependence on the relationship of the operating point with respect to the characteristic field.

2. A method according to claim 1, wherein: said step of varying the magnitude of the differential component of the control output signal includes generating a differential time constant signal in accordance with the relationship of the operating point to the characteristic curve and inputting said time constant into the differential controller, said time constant being a function of at least one operating variable at the operating point in relationship to the characteristic field.

3. A method according to claim 1, wherein: said step of varying the magnitude of the differential component of the control output signal includes generating a differential time constant signal by determining the gradient of variation of power and determining the turbocompressor blade position of the compressor characteristic curve in respect to a sensed operating point and varying the differential time constant as a function of the gradient, in particular inversely proportional to the compressor characteristic curve gradient and inputting said time constant into the differential controller.

4. A method according to claim 1, wherein: said step of varying the magnitude of the differential component of the control output signal includes forming a differentia; time constant which is varied as a function of the distance in the characteristic field of the operating point from a blow-off line curve in the operating field and inputting said time constant into the differential controller.

5. A method according to claim 1, wherein: said step of varying the magnitude of the differential component of the control output signal includes generating a differential time constant having a magnitude which is varied as a function of at least one operating variable and inputting said time constant into the differential controller.

6. A method according to claim 5, wherein: the magnitude of the differential component of the control output signal is varied as a function of the control output signal.

7. A method according to claim 5, wherein: the magnitude of the differential component of the control output signal is varied as a function of the controller's output signal.

8. An apparatus for controlling the operation of a turbocompressor having an intake line and a discharge line with a blow-off valve, the turbocompressor having a characteristic field of operation based on a relationship between one or more operating variables of the turbocompressor, the turbocompressor operating at an operating point lying in the characteristic field, a charcteristic curve of the turbocompressor representing a predetermined preferred relationship between one or more of the operating variables lying in the characteristic field including a blow-off curve lying in the characteristic field, comprising: sensor means at the intake line and discharge line for generating an input signal from a continuous acquired actual value of at least one operating variable of the turbocompressor providing an indication of at least one of the volumetric flow, inlet pressure, discharge pressure and compression ratio; memory means for storing said characteristic curves including said blow-off curve; control means connected to said sensor means for receiving said input signal and connected to said memory means for accessing said characteristic curves including said blow-off curve, said computer means comparing said input signal to said characteristic curve and outputting a set point signal indicative of the relationship of said operating point to said characteristic curve; control means for receiving said input signal and said set point signal and for generating an output control signal, said control means including a differential controller for receiving said input signal and forming a differential component of the output control signal, said differential component being the derivative of the input signal representing the rate of change on the input signal; and, means for receiving said set point signal and generating a differential time constant based on said set point signal, such that said differential time constant varies as a function of at least one operating variable at the operating point with respect to the characteristic field.

* * * * *